US008237380B2

(12) United States Patent
Chang et al.

(10) Patent No.: US 8,237,380 B2
(45) Date of Patent: Aug. 7, 2012

(54) METHOD OF ARRANGING LIGHT EMITTING DIODES SUPPLIED BY AC POWER WITH LOW LOSS AND SMOOTH ILLUMINATION IN A HIGH EXPANDABLE STRUCTURE

(75) Inventors: Kun-Chieh Chang, Taipei (TW); Ko-Wen Jwo, Taipei (TW)

(73) Assignee: King Diode Co., Ltd., Taipei (TW)

( * ) Notice: Subject to any disclaimer, the term of this patent is extended or adjusted under 35 U.S.C. 154(b) by 240 days.

(21) Appl. No.: 12/850,619

(22) Filed: Aug. 4, 2010

(65) Prior Publication Data

US 2012/0032607 A1 Feb. 9, 2012

(51) Int. Cl.
*H05B 37/00* (2006.01)

(52) U.S. Cl. ..... 315/312; 315/250; 315/315; 315/317; 315/320; 362/249.13; 313/500; 313/505

(58) Field of Classification Search ..... 315/246, 315/250, 312–315, 317, 320; 362/249.06, 362/249.14; 313/297, 300, 500, 505
See application file for complete search history.

(56) References Cited

U.S. PATENT DOCUMENTS

| | | | | |
|---|---|---|---|---|
| 6,194,839 | B1 * | 2/2001 | Chang | 315/185 S |
| 7,259,030 | B2 * | 8/2007 | Daniels et al. | 438/22 |
| 7,834,364 | B2 * | 11/2010 | Lee | 257/82 |
| 2004/0016923 | A1 * | 1/2004 | Yu et al. | 257/49 |
| 2004/0119933 | A1 * | 6/2004 | Harada et al. | 349/175 |
| 2008/0191220 | A1 * | 8/2008 | Daniels et al. | 257/88 |

* cited by examiner

*Primary Examiner* — Jason M Crawford
(74) *Attorney, Agent, or Firm* — Lin & Associates IP, Inc.

(57) ABSTRACT

A method of arranging light emitting diodes (LEDs) is disclosed. The method includes M virtual lateral lines and N virtual vertical lines, which form virtual intersection nodes at the intersections; disposing N-1 lateral LEDs in each virtual lateral line with one lateral LED placed between two adjacent virtual intersection nodes, connecting the positive terminal of one later LED to the positive terminal of one of the two adjacent lateral LEDs, and connecting the negative terminal of the one lateral LED to the negative terminal of the other adjacent lateral LED; disposing M-1 vertical LEDs in each virtual vertical line except for the first and last virtual vertical lines, connecting the positive and negative terminal of one vertical LED in the same way; and connecting the AC power to the first and last virtual vertical lines.

6 Claims, 5 Drawing Sheets

METHOD OF ARRANGING LIGHT EMITTING DIODES SUPPLIED BY AC POWER WITH LOW LOSS AND SMOOTH ILLUMINATION IN A HIGH EXPANDABLE STRUCTURE

BACKGROUND OF THE INVENTION

1. Field of the Invention

The present invention generally relates to an arrangement of the LEDs, and more specifically to arranging the LEDs supplied by AC power with low loss and smooth illumination in a high expandable structure.

2. The Prior Arts

At present, the LED is a widely used semiconductor light source with one positive terminal and one negative terminal. The LED mainly comprises a PN junction as a light emitting layer which emits light when DC (direct current) voltage beyond the turn on threshold (i.e. forward voltage) is supplied. Thus, the LED needs DC power instead of conventional AC (alternative current) power. For the conventional AC power, such as city power or the output power from the electric motor, an appropriate rectifying device is usually used to transform the AC power to the DC power as desired. Thus, the entire cost increases and the complexity and the layout of the rectifying circuit is an issue for the reliability.

Therefore, it is needed to provide an arrangement of the LEDs to directly turn on by DC power without any rectifying device or other passive elements consuming some of the power so as to overcome the above mentioned drawbacks of the prior arts.

SUMMARY OF THE INVENTION

In accordance with the present invention, a method of arranging LEDs supplied by AC power with low loss and smooth illumination in a high expandable structure is provided, comprising the steps of:

(a) building up a virtual grid having M virtual lateral lines and N virtual vertical lines, which form multiple virtual intersection nodes at the intersection of the M virtual lateral line and the N virtual vertical line;

(b) disposing N−1 lateral LEDs in each virtual lateral line with one lateral LED placed between two adjacent virtual intersection nodes, connecting the positive terminal of one lateral LED to the positive terminal of one of the two adjacent lateral LEDs, and connecting the negative terminal of the one lateral LED to the negative terminal of the other adjacent lateral LED;

(c) disposing M−1 vertical LEDs in each virtual vertical line except the first and last virtual vertical lines with one vertical LED placed between two adjacent virtual intersection nodes, connecting the positive terminal of one vertical LED to the positive terminal of one of the two adjacent vertical LEDs, and connecting the negative terminal of the one vertical LED to the negative terminal of the other adjacent vertical LED; and (d) connecting the AC power to the first and last virtual vertical lines.

One aspect of the present invention is to provide a lossless scheme to always turn on the lateral LEDs by the AC power without any rectifying circuitry or passive electrical elements consuming some of the electrical power. Although the vertical LEDs are alternatively turned on/off by AC power, smooth illumination is achieved because of the frequency of the AC power, for example, 60 Hz.

Another aspect of the present invention is to provide an expandable arrangement of the LEDs such that the number of the LEDs is easily increased with the similar connecting scheme to meet the preferred illumination as desired.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENT

The present invention may be embodied in various forms and the details of the preferred embodiments of the present invention will be described in the subsequent content with reference to the accompanying drawings. The drawings (not to scale) show and depict only the preferred embodiments of the invention and shall not be considered as limitations to the scope of the present invention. Modifications of the shape of the present invention shall too be considered to be within the spirit of the present invention.

Hereinafter, a method of arranging the LEDs to turn on by the external AC power according to a preferred embodiment of the present invention will be described in detail with reference to the accompanying drawings.

Figure 1:
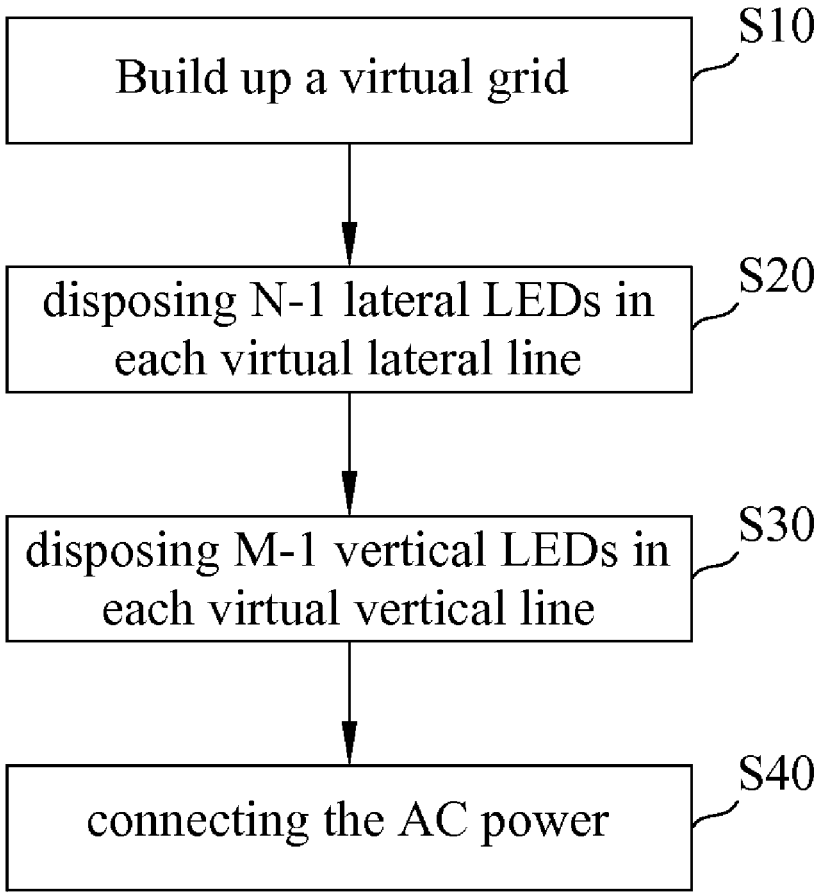
FIG. 1 shows a flow chart to illustrate the process of the method according to the present invention.

FIG. 1 shows a flow chart to illustrate the process of the method according to the present invention. The process of the method of the present invention starts at step S10 to build up a virtual grid. The virtual grid is composed of M virtual lateral lines and N virtual vertical lines, which form multiple virtual intersection nodes at the intersections.

Then the process proceeds to step S20 to dispose N−1 lateral LEDs in each virtual lateral line with one lateral LED placed between two adjacent virtual intersection nodes. The positive terminal of one lateral LED is connected to the positive terminal of one of the two adjacent lateral LEDs by the connection line. The connection line may be made of electrical conductive metal or organic conductive material. The electrical conductive metal may includes copper or copper alloy. The organic conductive material may include organic conductive polymer, such as polyacetylene or halogen-doped polyacetylene. The negative terminal of the one lateral LED is connected to the negative terminal of the other adjacent lateral LED by the connection line.

After step S20, step S30 is executed to dispose the vertical LEDs. At the step S30, each virtual vertical line except the first and last virtual vertical lines is placed with M−1 vertical LEDs in a way that one vertical LED is placed between two adjacent virtual intersection nodes. The positive terminal of one vertical LED is connected to the positive terminal of one of the two adjacent vertical LEDs by the respective connection line, and the negative terminal of the one vertical LED is connected to the negative terminal of the other adjacent vertical LED by the respective connection line.

Finally, at step S40, the AC power is connected to the first and last virtual vertical lines by the respective connection lines.

Figure 2:
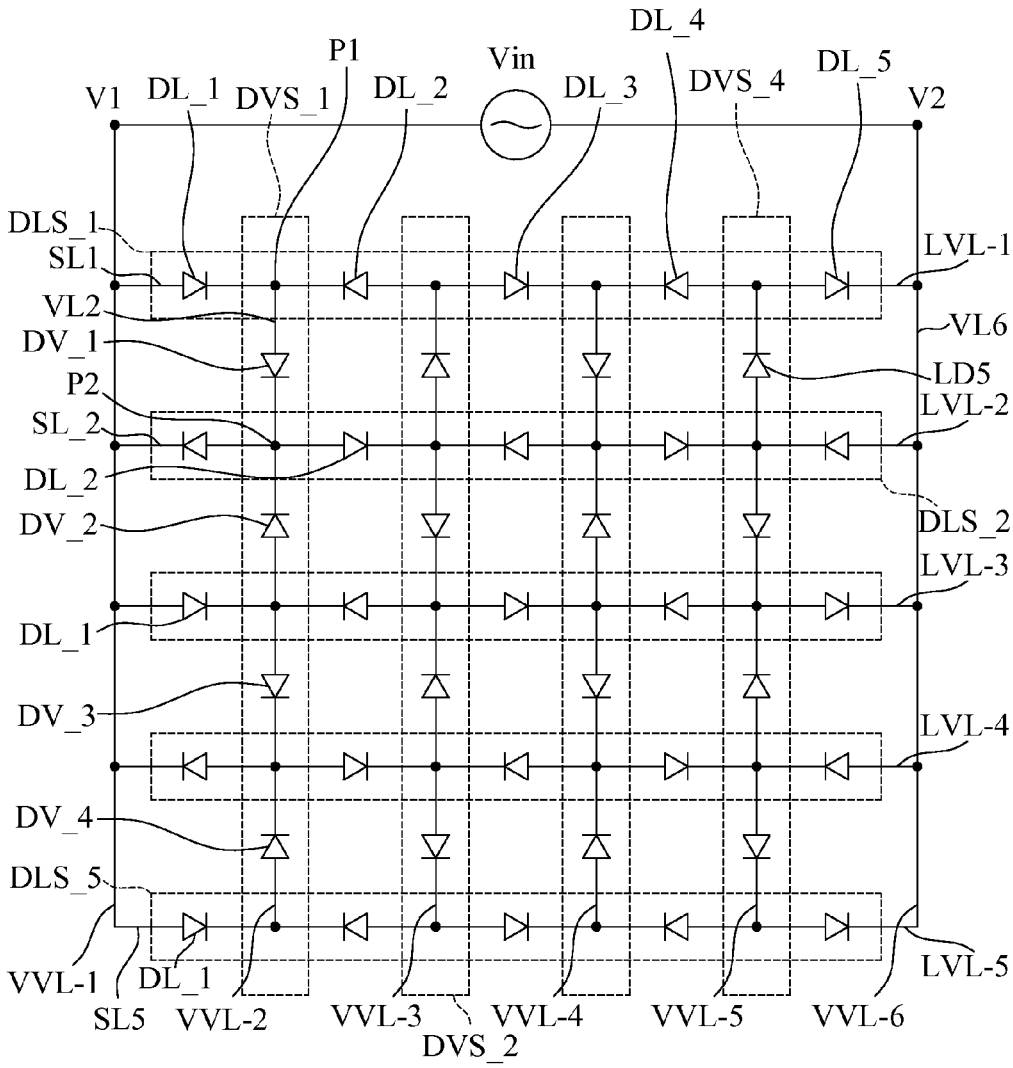
FIG. 2 shows an exemplary arrangement of the LEDs according to the present invention.

For further illustration of the above method, please refer to FIG. 2 showing an exemplary arrangement of the LEDs according to the present invention. FIG. 2 is only intended to illustrate the aspect of the embodiment of the present invention. A virtual grid with 5 lateral virtual lines and 6 vertical virtual lines are used to be placed with 5×5 lateral LEDs and 4×4 vertical LEDs. While the connection lines are needed to connect the adjacent LEDs and the power lines and the LEDs, the respective connection lines are not mentioned below for simplicity, It should be noted that the numbers of the lateral and vertical virtual lines as well as the numbers of the lateral and vertical LEDs are not limited by the above embodiment.

A shown in FIG. 2, 5 lateral LEDs as indicated by DL_1, DL_2, DL_3, DL_4, and DL_5 form the first lateral LED string DLS_1 (enclosed by dashed line) and are disposed on the first lateral virtual line LVL_1.

The positive terminal of the first lateral LED DL_1 is connected to the first vertical virtual line VVL_1. The negative terminal of the first lateral LED DL_1 is connected to the negative terminal of the second lateral LED DL_2. Likewise, other lateral LEDs are connected as shown in FIG. 2.

The positive terminal of the last (fifth) lateral LED DL_5 is connected to the positive terminal of the fourth lateral LED DL_4, and the negative terminal of the last lateral LED DL_5 is connected to the last (sixth) vertical virtual line VVL_6.

Similarly, other lateral LEDs are disposed on the corresponding lateral virtual lines by use of the above arrangement. It should be noted that the orientation of the lateral LEDs in the second lateral virtual line LVL_2 is reverse to that in the first lateral virtual line LVL_1. Thus, the orientation of the lateral LEDs in different lateral virtual lines is alternatively changed.

For the vertical virtual lines except the first and last vertical virtual lines VVL_1 and VVL_6, 4 vertical LEDs (DV_1, DV_2, DV_3, and DV_4) are disposed on each vertical virtual line, i.e., the second vertical virtual line VVL_2 to the fifth vertical virtual line VVL_5. Furthermore, each vertical LED is disposed between 2 adjacent intersection nodes on the same vertical virtual line. The connection of the positive and negative terminals of the vertical LED is similar to that of lateral LED as mentioned above.

The AC power Vin is connected to the first and last vertical virtual line VVL_1 and VVL_6.

Figure 3:
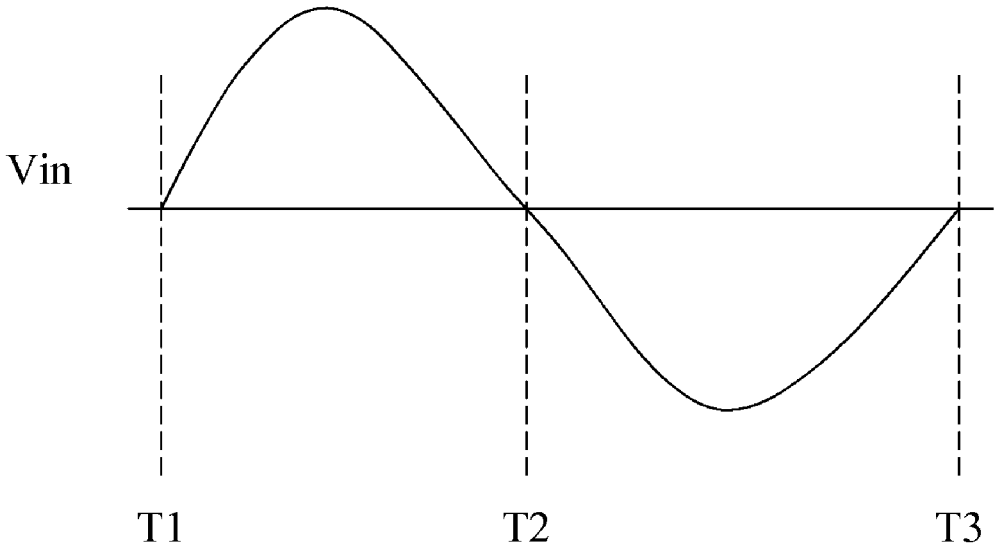
FIG. 3 shows the waveform of the AC power supplied to the LEDs according to the present invention.

Typically, the waveform of the AC power Vin supplied to the LEDs according to the present invention is shown in FIG. 3. For the period between time T1 and time T2, the voltage of the AC power Vin is positive, referred as positive phase; and the voltage of the AC power Vin is negative during the period between time T2 and time T3, referred as negative phase.

Figure 4:
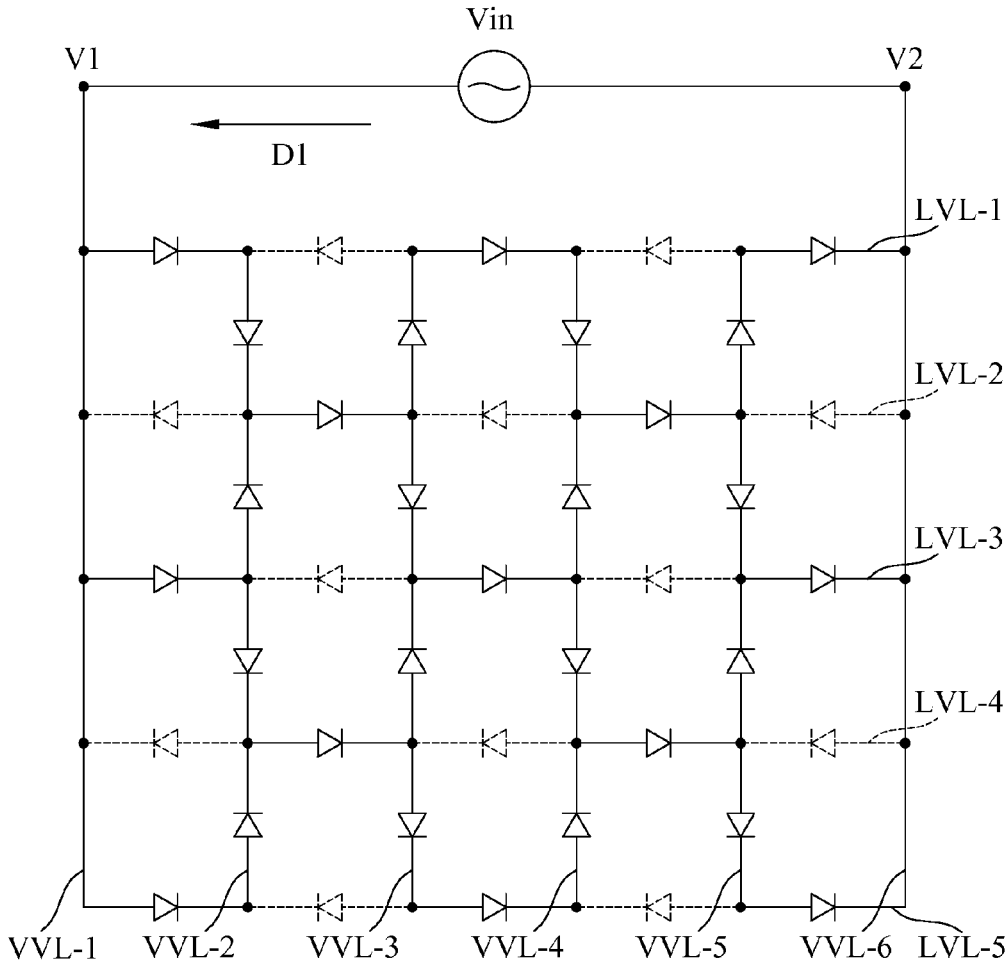
FIG. 4 shows the LEDs turned on during the positive phase of the AC power according to the present invention.

FIG. 4 shows the LEDs turned on during the positive phase of the AC power according to the present invention. The lateral and vertical LEDs represented by solid line are turned on during the positive phase. It is clear that all 16 vertical LEDs, 4×4 vertical LEDs, are turned on. About one half of the total lateral LEDs, 13 lateral LEDS, are turned on and the other lateral LEDs are still turned off. Therefore, The AC power Vin supplies a current D1 to the LEDs.

Figure 5:
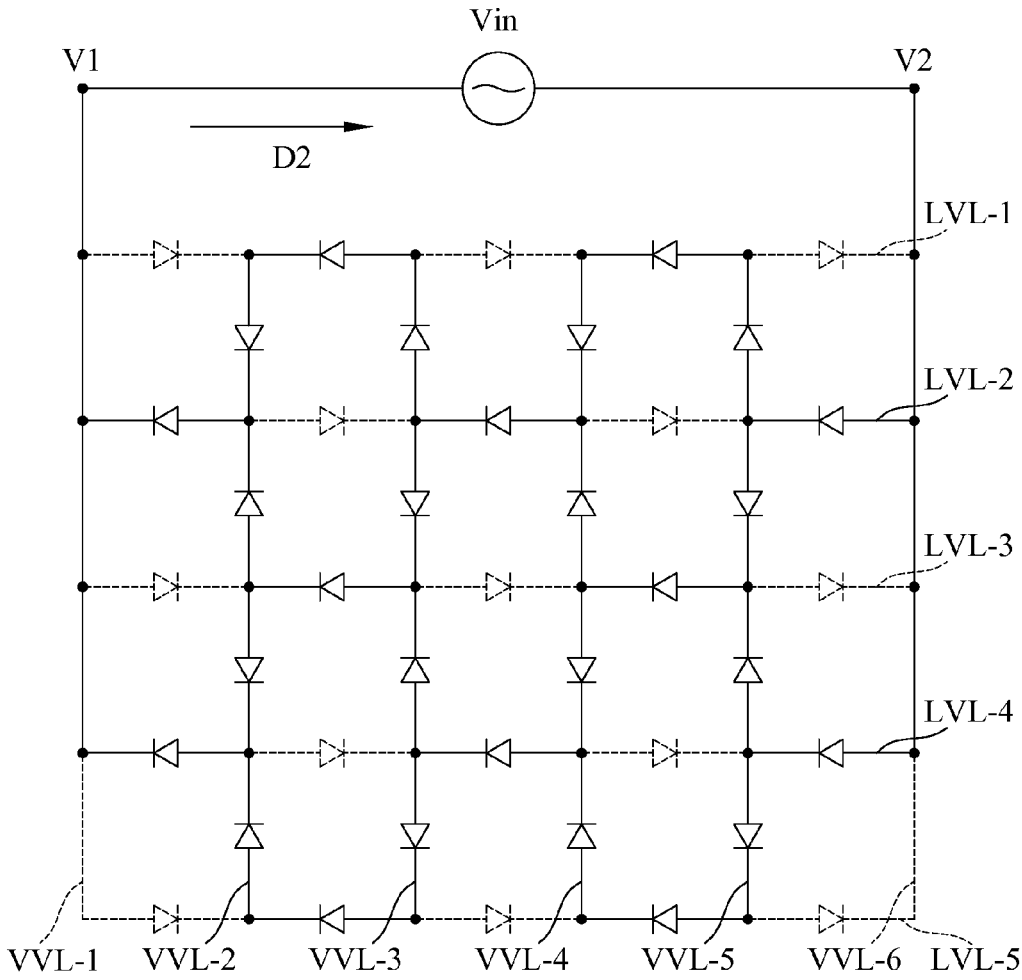
FIG. 5 shows the LEDs turned on during the negative phase of the AC power according to the present invention.

For comparison, FIG. 5 shows the LEDs turned on during the negative phase of the AC power according to the present invention. As shown in FIG. 5, all vertical LEDs are turned on. About one half of the lateral LEDs are turned off and the other lateral LEDs are turned on. Therefore, The AC power Vin supplies another current D2 to the LEDs.

Therefore, the vertical LEDs are turned on during both positive and negative phases of the AC power Vin and the lateral LEDs are turned on/off, alternatively such that the arrangement of the LEDs according to the method of the present invention can perform acceptable smooth illumination supplied by only AC power without any other electrical elements or devices. Moreover, the arrangement of the LEDs can provide smooth illumination if the frequency of the AC power higher than the threshold of human eyes, for example, 60 Hz for the city power.

Another advantage of the present invention is provide an expandable structure, that is, the above embodiment shown in FIG. 2 can be used an LED module having (N−1)×M lateral LEDs and (M−1)×(N−2) vertical LEDs, and a plurality of such an LED module can be easily integrated to form a larger size LED device with increased illumination without any other electrical elements.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method of arranging light emitting diodes (LEDs), supplied by an AC power with low loss and smooth illumination in a high expandable structure, comprising:

building up a virtual grid having M virtual lateral lines and N virtual vertical lines, which form multiple virtual intersection nodes at the intersection of the M virtual lateral line and the N virtual vertical line;

disposing N−1 lateral LEDs of the LEDs in each virtual lateral line except the first and the last virtual vertical lines with one lateral LED placed between two adjacent virtual intersection nodes, connecting the positive terminal of one lateral LED to the positive terminal of one of the two adjacent lateral LEDs, and connecting the negative terminal of the one lateral LED to the negative terminal of the other adjacent lateral LED;

disposing M−1 vertical LEDs of the LEDs in each virtual vertical line except the first and last virtual vertical lines with one vertical LED placed between two adjacent virtual intersection nodes, connecting the positive terminal of one vertical LED to the positive terminal of one of the two adjacent vertical LEDs, and connecting the negative terminal of the one vertical LED to the negative terminal of the other adjacent vertical LED; and connecting the AC power to the first and last virtual vertical lines.

2. The method as claimed in claim 1, wherein said AC power is a city power with a frequency of 60 Hz.

3. The method as claimed in claim 1, wherein the LEDs are connected by connection lines.

4. The method as claimed in claim 3, wherein said connection lines are made of an electrical conductive metal or organic conductive material.

5. The method as claimed in claim 4, wherein said electrical conductive metal comprises copper or copper alloy and said organic conductive material comprises organic conductive polymer.

6. The method as claimed in claim 5, wherein said organic conductive polymer comprises polyacetylene or halogen-doped polyacetylene.

* * * * *